US011624150B2

(12) United States Patent
Kim et al.

(10) Patent No.: US 11,624,150 B2
(45) Date of Patent: Apr. 11, 2023

(54) GARMENT FOLDING MACHINE AND METHOD OF CONTROLLING SAME

(71) Applicant: LG Electronics Inc., Seoul (KR)

(72) Inventors: Keun Joo Kim, Seoul (KR); Kyosoon Chae, Seoul (KR); Sung Hoon Ahn, Seoul (KR); Choongho Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 17/329,977

(22) Filed: May 25, 2021

(65) Prior Publication Data

US 2021/0363684 A1 Nov. 25, 2021

(30) Foreign Application Priority Data

May 25, 2020 (KR) ..... 10-2020-0062552

(51) Int. Cl.
*D06F 89/02* (2006.01)

(52) U.S. Cl.
CPC ..... *D06F 89/02* (2013.01)

(58) Field of Classification Search
CPC ..... D06F 89/00; D06F 89/02; D06F 89/023; A41H 43/025; A41H 43/0257
See application file for complete search history.

(56) References Cited

U.S. PATENT DOCUMENTS

| | | | | |
|---|---|---|---|---|
| 9,752,277 | B2 * | 9/2017 | Nakahara | D06F 69/00 |
| 11,208,757 | B2 * | 12/2021 | Bringewatt | D06F 67/10 |
| 11,214,916 | B2 * | 1/2022 | Maeshima | D06F 89/00 |
| 11,261,562 | B2 * | 3/2022 | Nitschmann | D06F 89/023 |

FOREIGN PATENT DOCUMENTS

| | | |
|---|---|---|
| JP | 2005131005 | 5/2005 |
| JP | 2016150025 | 8/2016 |
| KR | 102077452 | 2/2020 |
| KR | 20200042936 | 4/2020 |
| KR | 20200047641 | 5/2020 |

OTHER PUBLICATIONS

International Search Report in International Appln. No. PCT/KR2021/006483, dated Sep. 23, 2021, 6 pages (with English translation).

* cited by examiner

*Primary Examiner* — F Griffin Hall
(74) *Attorney, Agent, or Firm* — Fish & Richardson P.C.

(57) ABSTRACT

The present disclosure relates to a garment folding machine and a method of controlling the garment folding machine, in which it is possible to effectively prevent damage to a garment by controlling and reducing tension after detecting and determining a situation in which the tension is applied to the garment during a process of conveying or folding the garment, and it is possible to allow the folding machine to smoothly perform vertical folding by disposing the garment at an appropriate position in order to perform the vertical folding.

14 Claims, 9 Drawing Sheets

GARMENT FOLDING MACHINE AND METHOD OF CONTROLLING SAME

CROSS-REFERENCE TO RELATED APPLICATION

This application claims the benefit of priority to Korean Application No. 10-2020-0062552, filed on May 25, 2020, the disclosure of which is incorporated by reference in its entirety.

TECHNICAL FIELD

The present disclosure relates to a method of controlling a garment folding machine, and more particularly, to a garment folding machine and a method of controlling the garment folding machine, which are capable of controlling a position of a garment in order to reduce tension to be applied to the garment during a process of conveying and folding the garment.

BACKGROUND

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automatic folding machine capable of quickly folding a garment without variation.

Regarding the garment folding machine in the related art, International Patent Publication No. 2018-122841 (hereinafter, referred to as a 'related art document') discloses a configuration of a folding machine in which a garment is loaded from above, folded, and then discharged while moving downward and passing through a plurality of folding layers stacked in multiple stages.

However, in the case of the folding machine disclosed in related art document, a garment having a long length may be caught between the layers and tension may be applied to the caught garment during a process in which various types of garments having different thicknesses and different lengths are folded or conveyed in the plurality of folding layers stacked in multiple stages. However, the related art document does not propose a means and/or a method for solving the problem with tension applied to the garment as described above.

In a case in which a drive motor, which is involved in the process of conveying and folding the garment, continuously operates even in the state in which the tension is applied to the garment, there is a problem in that the garment is highly likely to be damaged.

In addition, there is a problem in that in the state in which the tension is applied to the garment, intended vertical folding cannot be implemented even though a vertical folding means of the folding machine operates.

PATENT DOCUMENT (Patent Document 0001) International Patent Publication No. 2018-122841

SUMMARY

The present disclosure has been made in an effort to solve the aforementioned problems, and a first object of the present disclosure is to provide a garment folding machine and a method of controlling the garment folding machine, which are capable of detecting and determining a state in which tension is applied to a garment during a process of conveying or folding the garment, and stopping a drive motor corresponding to a layer in which the corresponding garment is disposed, thereby effectively preventing damage to the garment.

In addition, a second object of the present disclosure is to provide a garment folding machine and a method of controlling the garment folding machine, which are capable of detecting and determining a disposition of a garment before a vertical folding process and disposing the garment at a position at which a vertical folding function may be effectively exhibited, thereby improving the vertical folding function.

In one aspect, the present disclosure provides a garment folding machine including: a frame unit configured to define an external shape; a loading unit supported on the frame unit and configured to load a garment; a folding unit including two or more folding layers configured to convey the garment loaded by the loading unit and to fold the garment; an unloading unit configured to discharge the garment folded by the folding unit; and a control unit configured to generate a control signal for controlling the loading unit and the folding unit, in which the folding unit includes: a first folding layer; and a second folding layer disposed below the first folding layer and configured to vertically fold the garment conveyed from the first folding layer, in which the second folding layer includes: a second conveyor configured to circulate to allow the garment to slide; a second conveyor motor configured to operate forward or rearward to provide power for operating the second conveyor; and a second-conveyor-front-end garment detection sensor disposed at a front end of the second conveyor and configured to detect an entry of the garment and transmit a signal to the control unit, and in which the control unit controls and operates the second conveyor motor rearward when the control unit receives the signal transmitted from the second-conveyor-front-end garment detection sensor.

The control unit may control and temporarily stop the second conveyor motor when reception of the signal transmitted from the second-conveyor-front-end garment detection sensor is stopped.

The control unit may control and operate the second conveyor motor rearward at a speed lower than a forward operation speed.

The first folding layer may include: a first conveyor configured to circulate to allow the garment to slide; a first conveyor motor configured to operate forward or rearward to provide power for operating the first conveyor; and a first-conveyor-rear-end garment detection sensor disposed at a rear end of the first conveyor and configured to detect an entry of the garment and transmit a signal to the control unit, and the control unit may control and operate the second conveyor motor rearward when the control unit receives the signal transmitted from the second-conveyor-front-end garment detection sensor before the reception of the signal transmitted from the first-conveyor-rear-end garment detection sensor is stopped.

The second folding layer may further include: a vertical folding assembly configured to implement vertical folding on the garment conveyed from the first folding layer, the vertical folding assembly may further include: a vertical folding motor configured to provide driving power for the vertical folding; and vertical folding plates provided in the form of a pair of boards with the second conveyor interposed therebetween and configured to perform the vertical folding on the garment loaded to the second conveyor, and the control unit may perform control such that when the second conveyor motor is temporarily stopped after the garment is loaded to the second conveyor, the vertical folding motor operates to move the vertical folding plates upward to vertically fold the garment.

The vertical folding assembly may further include: plate support parts disposed below the vertical folding plates, connected to the vertical folding motor, and configured to move the vertical folding plates upward by being supplied with driving power; vertical folding frames configured to define an internal space in which the plate support parts are disposed; and vertical folding link pins connected to the vertical folding frames while penetrating the plate support parts, and vertical folding link guide holes for guiding movements of the vertical folding link pins may be formed in sidewalls of the vertical folding frames.

In another aspect, the present disclosure provides a method of controlling a garment folding machine, the method including: a folding layer operating step of controlling an operation of a conveyor motor that operates the one or more conveyors to fold or convey the garment; a garment position detection step of detecting a position of the garment using a garment detection sensor provided in the folding layer after the conveyor motor operates; and a rearward operation control step of controlling and operating the conveyor motor rearward when receiving a signal transmitted from the garment position detection step.

In addition, the garment position detection step may include a signal transmission stopping step of determining that the garment departs from an upper side of the garment detection sensor when the detection of the entry of the garment is stopped as the conveyor motor operates rearward in the rearward operation control step, and stopping the reception of the rearward operation signal from the garment detection sensor, and the rearward operation control step may be ended when the reception of the rearward operation signal is stopped.

In addition, the folding layer operating step may include: a first folding layer operating step of operating a first folding layer which is an uppermost layer among the plurality of folding layers; and a second folding layer operating step of operating a second folding layer disposed below the first folding layer, the garment position detection step may include a second-folding-layer-garment-position detection step of detecting the entry of the garment using a second-conveyor-front-end garment detection sensor disposed at one side of the second folding layer, and the rearward operation control step may include a second-conveyor-motor-rearward-operation control step of controlling and operating a second conveyor motor rearward.

In addition, the second-folding-layer-garment-position detection step may include a second signal transmission stopping step of stopping transmitting a rearward operation signal from the second-conveyor-front-end garment detection sensor to a control unit when the detection of the entry of the garment by the second-conveyor-front-end garment detection sensor is stopped as the second conveyor motor operates rearward, and the second-conveyor-motor-rearward-operation control step may be controlled and immediately ended when the reception of the rearward operation signal is stopped.

In addition, the method may further include a vertical folding step of performing vertical folding on the garment loaded into the folding layer using a vertical folding assembly provided in the one or more folding layers.

In addition, the vertical folding step may include: a vertical folding motor control step of controlling and operating a vertical folding motor provided in the vertical folding assembly when it is determined that the garment loaded into the folding layer reaches a vertical folding position; and a vertical folding performing step of vertically folding the garment by vertical folding plates moved upward by power of the operating vertical folding motor.

In addition, the vertical folding step may include: a vertical folding motor returning control step of returning the vertical folding plates while controlling the rearward operation of the conveyor motor when it is determined that the garment moves and departs from the vertical folding position; a vertical folding returning control stopping step of stopping the returning control for the vertical folding plates when reception of a garment entry detection signal from the garment detection sensor is stopped as the conveyor motor operates rearward, and the vertical folding motor control step may be performed again when the vertical folding returning control stopping step is ended.

In addition, the folding layer operating step may include: a first folding layer operating step of operating a first folding layer which is an uppermost layer among the plurality of folding layers; and a second folding layer operating step of operating a second folding layer disposed below the first folding layer, the garment position detection step may include a second-folding-layer-garment-position detection step of determining that the garment departs from a target position, by receiving, by a control unit, a signal transmitted when a second-conveyor-front-end garment detection sensor disposed at one side of the second folding layer detects the loaded garment, and the vertical folding step may include a second-folding-layer vertical folding step of performing vertical folding on the garment loaded into the second folding layer using a vertical folding assembly disposed at one side of the second folding layer.

According to the method of controlling the garment folding machine according to the present disclosure has the following effects. First, it is possible to prevent damage to the garment by reducing tension applied to the garment by detecting the position of the garment using the sensor and then operating the conveyor rearward during the folding process. Second, it is possible to successfully perform the vertical folding function by controlling the position of the garment before vertically folding the garment.

DETAILED DESCRIPTION

Figure 1:
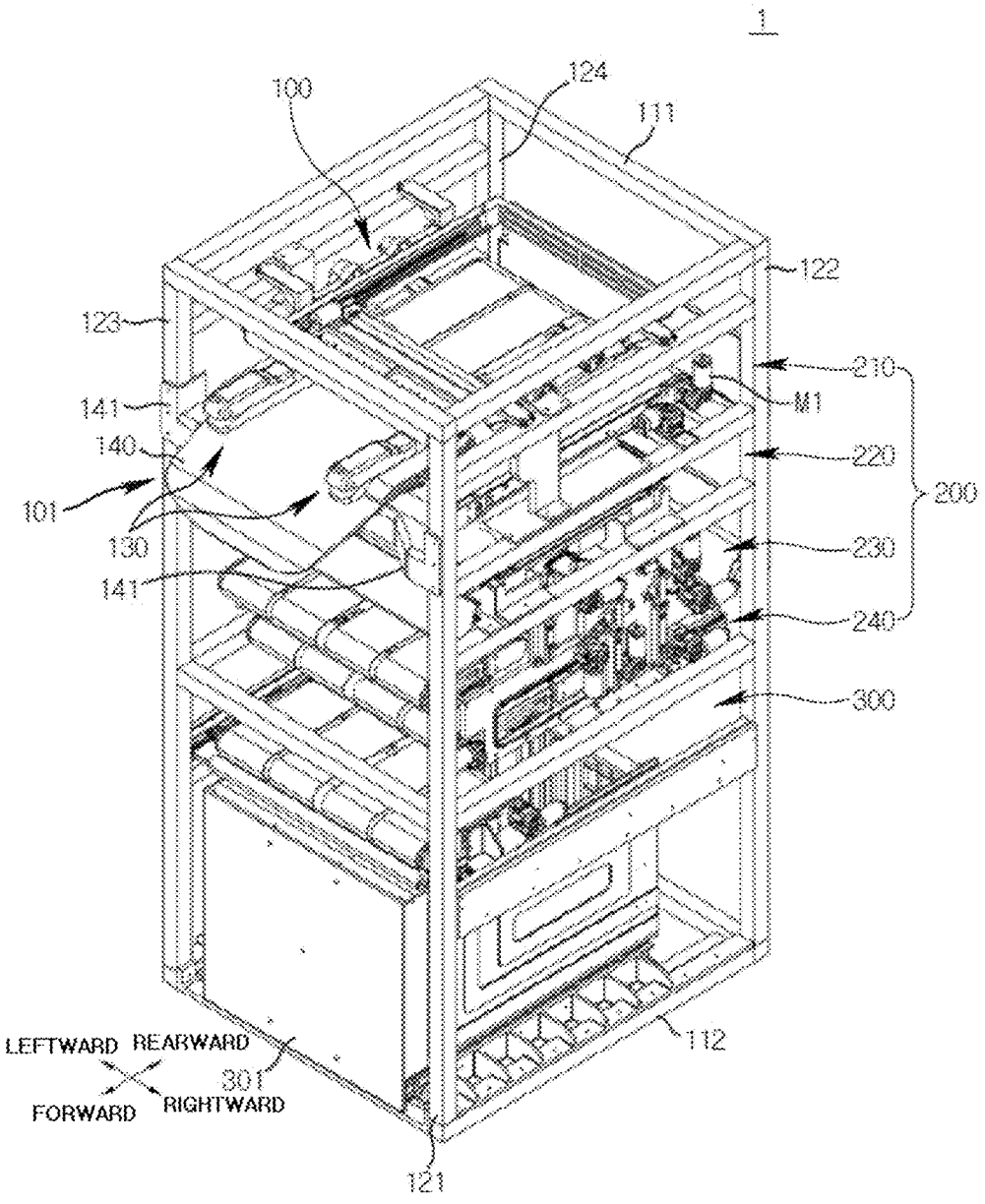
FIG. 1 is a schematic configuration view illustrating a basic configuration of a garment folding machine according to the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" includes any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Hereinafter, a garment folding machine 1 according to the present disclosure will be described with reference to FIGS. 1 to 3.

Figure 2:
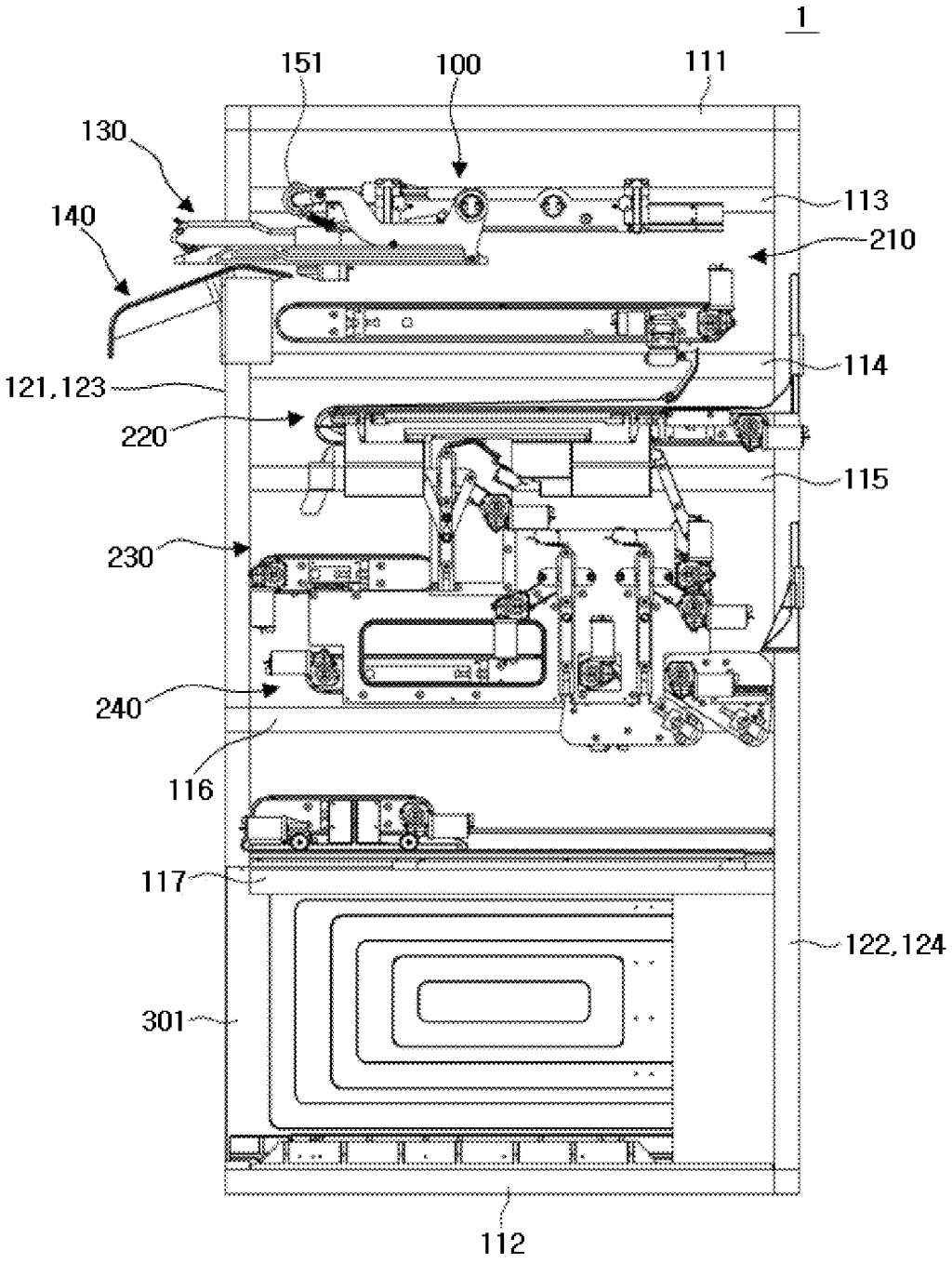
FIG. 2 is a side view of FIG. 1, that is, a schematic view illustrating a plurality of folding layers disposed as a layered structure.
Figure 3:
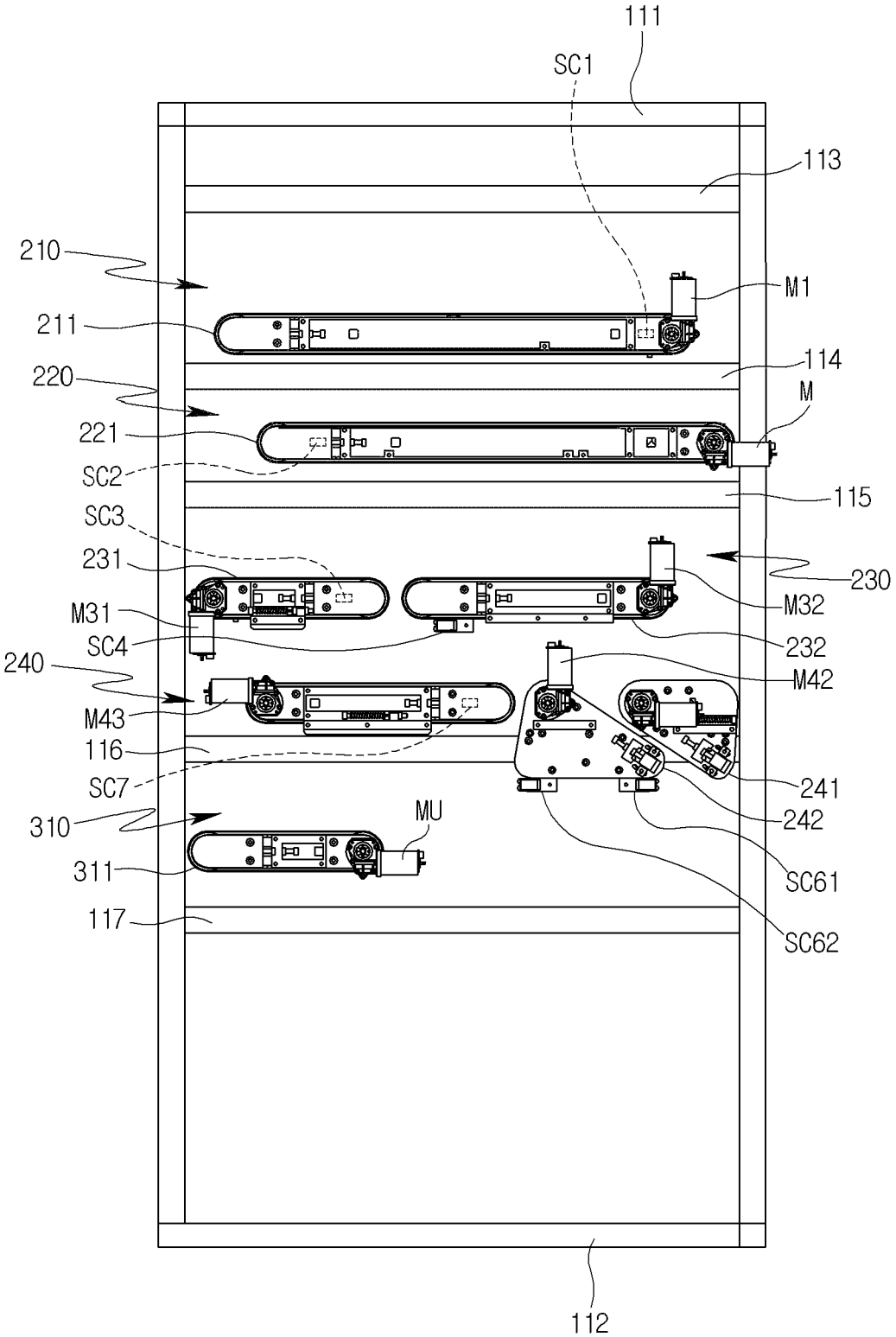
FIG. 3 is a schematic view illustrating conveyor structures of individual folding layers in the configuration illustrated in FIG. 2.

Referring to FIGS. 1 to 3, the garment folding machine 1 according to the present disclosure includes a frame unit that serves as an external framework.

The frame unit is disposed at an outer edge of the garment folding machine 1 and defines a minimum operating space in the garment folding machine 1. The frame unit may stably support several members constituting the garment folding machine 1.

In more detail, the frame unit includes an upper frame 111, a lower frame 112, a plurality of horizontal frames 113, 114, 115, 116, and 117, and a plurality of vertical frames 121, 122, 123, and 124.

The upper frame 111 is horizontally disposed at an upper end of the garment folding machine 1, and an upper operating space of the garment folding machine 1 may be defined by the upper frame 111.

The lower frame 112 may be horizontally disposed at a lower end of the garment folding machine 1 and may support the garment folding machine 1 on a floor. A lower operating space of the garment folding machine 1 may be defined by the lower frame 112.

The plurality of horizontal frames 113, 114, 115, 116, and 117 may be horizontally disposed between the upper frame 111 and the lower frame 112. A loading unit 100, a folding unit 200, and an unloading unit 300, which will be described below, may be mounted and supported on the plurality of horizontal frames 113, 114, 115, 116, and 117.

A space between the two horizontal frames may be defined as an operating space for an individual folding layer.

For example, an operating space for a second folding layer 220 (see FIGS. 2 and 3) for performing vertical folding may be defined by a second horizontal frame 114 and a third horizontal frame 115.

Meanwhile, the space between the two horizontal frames may also be defined as an operating space for the two folding layers.

For example, an operating space for the third folding layer 230 and the fourth folding layer 240 (see FIGS. 2 and 3) for performing horizontal folding may be defined by the third horizontal frame 115 and a fourth horizontal frame 116.

In addition, a first horizontal frame 113 disposed adjacent to the upper frame 111 may be provided to support a clip assembly 130 for holding and conveying a garment inputted into a loading part 101. A fifth horizontal frame 117 disposed adjacent to the lower frame 112 may be provided below a guide rail to support the guide rail that serves to allow an unloading conveyor 311 to be described below to slide in a forward/rearward direction.

Meanwhile, the vertical frames 121, 122, 123, and 124 include first and third vertical frames 121 and 123 disposed at a front side from which the garment is inputted, and second and fourth vertical frames 122 and 124 disposed to face the first and third vertical frames 121 and 123 and configured to define a rear operating space in the garment folding machine 1.

A finishing cover (not illustrated) may be stably attached to an outer peripheral side of the frame unit 110, and the finishing cover serves to define an external appearance of the garment folding machine 1 and protect the members disposed in the garment folding machine 1. In addition, an input unit (not illustrated), a display unit 600 (see FIG. 9), and an alarm unit 700 (see FIG. 9) may be provided on a front portion of the finishing cover, the input unit (not illustrated) is configured to receive a control instruction from a user, the display unit 600 is configured to visually provide the user with information on operating states of the garment folding machine 1, and the alarm unit 700 is configured to aurally provide the user with information on the operating states of the garment folding machine 1.

Since the frame unit is provided as described above, both a vertical folding assembly 222 and a horizontal folding assembly are supported at the same time so that the functions of conveying and folding the garment are smoothly performed by respective folding layers 210, 220, 230, and 240 of the folding unit 200 to be described below, such that a required space may be saved and an overall volume of the garment folding machine 1 may be reduced.

Meanwhile, the garment folding machine 1 may include the loading unit 100, the folding unit 200, and the unloading unit 300.

The loading unit 100, the folding unit 200, and the unloading unit 300 may be supported on the frame unit, and an operating space for the loading unit 100, an operating space for the folding unit 200, and an operating space for the unloading unit 300 may be defined by the frame unit.

For example, the operating space of the loading unit 100 may be defined by the upper frame 111 and the second horizontal frame 114, and the operating space of the unloading unit 300 may be defined by the fourth horizontal frame 116 and the lower frame 112.

The loading unit 100 serves to load the garment. The loading unit 100 serves to load the garment, which is inputted to the loading part 101, at a predetermined position on an upper surface of a first conveyor 211 of the first folding layer 210.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding machine 1.

As an example, the loading unit 100 includes the clip assembly 130 (see FIGS. 1 and 2) that holds the garment inputted by the loading part 101.

FIGS. 1 and 2 illustrate the clip assembly 130 configured to hold the garment at two points. For convenience, the clip assembly 130 configured to hold the garment at the two points will be described, but the present disclosure is not limited thereto.

When the garment is completely held at a first position corresponding to an initial position, the clip assembly 130 draws the garment into the garment folding machine 1 and moves the garment to a second position corresponding to a loading position on the upper surface of the first conveyor 211 while holding the garment and moving rearward by a predetermined distance. When the clip assembly 130 completely moves to the second position, the clip assembly 130 releases the garment.

In addition, after the clip assembly 130 releases the garment, the clip assembly 130 additionally moves to a third position, that is, a position disposed further rearward from the second position. When the clip assembly 130 reaches the third position, the first conveyor 211 of the first folding layer 210 begins to operate.

The loading unit 100 includes a loading unit motor configured to generate power for moving the clip assembly 130 in the forward/rearward direction. As an example, the loading unit motor has a pinion gear fixed to the clip assembly 130 and connected to an output shaft of the loading unit motor, and the pinion gear engages with a rectilinear gear fixed to a frame of the loading unit 100, such that rotational power of the loading unit motor may be converted into a force for rectilinear motion in the forward/rearward direction.

Meanwhile, clip position detection sensors SL for specifying the first to third positions are provided on the frame of the loading unit 100. In more detail, the clip position detection sensors SL include an initial position detection sensor SL1 configured to detect whether the clip assembly 130 is positioned at the first position, a clip open position detection sensor SL2 configured to detect whether the clip assembly 130 is positioned at the second position, and a stop position detection sensor SL3 configured to detect whether the clip assembly 130 is positioned at the third position.

The folding unit 200 serves to convey and fold the garment loaded by the loading unit 100.

In more detail, as illustrated in FIGS. 2 and 3, the folding unit 200 includes the four or more folding layers 210, 220, 230, and 240 so that the loaded garment is conveyed and folded to an appropriate size and shape. The four or more folding layers 210, 220, 230, and 240 are disposed to be spaced apart from one another in the upward/downward direction.

The loaded garment is folded one or more times while being conveyed from the folding layer at the upper side to the folding layer at the lower side, and the garments, which are completely folded to appropriate sizes and shapes, are collected in a discharge unit 301.

In the embodiment illustrated in FIG. 3, the folding unit 200 may include the four folding layers 210, 220, 230, and 240.

The four folding layers 210, 220, 230, and 240 are disposed to be spaced apart from one another in the upward/downward direction and serve to allow the loaded garment to be folded to an appropriate size and shape while being conveyed from the first folding layer 210 at the uppermost side to the fourth folding layer 240 at the lowermost side.

An unloading layer 310 may be disposed below the fourth folding layer 240 at the lowermost side. In the embodiment illustrated in FIG. 3, the unloading layer 310 may be further provided below the fourth folding layer 240, and the completely folded garment is dropped onto the unloading layer 310. As described above, the unloading layer 310 is provided with the discharge unit 301 such that the completely folded garments are uniformly collected.

Each of the folding layers 210, 220, 230, and 240 includes at least one conveyor 211, 221, 231, 241, 242, or 243. The conveyors 211, 221, 231, 241, 242, and 243 serve to convey or horizontally fold the loaded garment.

In more detail, in the embodiment illustrated in FIGS. 2 and 3, the first folding layer 210 includes a first conveyor 211 and a first conveyor motor M1 configured to operate the first conveyor 211.

In addition, the second folding layer 220 includes a second conveyor 221 and a second conveyor motor M21 configured to operate the second conveyor 221.

Meanwhile, the third folding layer 230 may include a third conveyor 231 and a fourth conveyor 232 spaced apart from each other at a predetermined interval, and a third conveyor motor M31 and a fourth conveyor motor M32 configured to operate the third conveyor 231 and the fourth conveyor 232, respectively.

As illustrated, the third conveyor 231 is disposed at the front side of the garment folding machine 1, the fourth conveyor 232 is disposed at the rear side of the garment folding machine 1, and an upper surface of the third conveyor 231 and an upper surface of the fourth conveyor are disposed approximately side by side.

Meanwhile, the predetermined interval defined between the third conveyor 231 and the fourth conveyor 232 of the third folding layer 230 is a first folding gap G1 that serves to allow the garment to pass through the first folding gap G1 while being horizontally folded.

In addition, the fourth folding layer 240 includes a fifth conveyor 241, a sixth conveyor 242, and a seventh conveyor 243 disposed sequentially from the rear side to the front side of the garment folding machine 1, and a fifth conveyor motor M41, a sixth conveyor motor M42, and a seventh conveyor motor M43 configured to operate the fifth conveyor 241, the sixth conveyor 242, and the seventh conveyor 243.

Two folding gaps may be defined between the fifth conveyor 241, the sixth conveyor 242, and the seventh conveyor 243 provided in the fourth folding layer 240 so that the garment may be horizontally folded or may pass through the two folding gaps while being horizontally folded.

In this case, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

Meanwhile, the folding unit 200 is configured to perform the vertical folding function that serves to vertically fold the loaded garment.

In the embodiment illustrated in FIG. 3, the first folding layer 210 and the second folding layer 220, which are the two upper folding layers among the four folding layers constituting the folding unit 200, are configured to vertically fold the garment.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

First, the first folding layer 210 may serve to vertically fold the garment loaded from the loading unit 100 while conveying the garment to a rear end thereof. In particular, the first folding layer 210 may vertically fold a sleeve portion of an upper garment that needs to be vertically folded.

Specifically, in a state in which the sleeve portion of the upper garment is folded to a predetermined degree by a seating plate 140 (see FIG. 1) provided in the loading part 101 of the loading unit 100 and by a primary vertical folding guide 141 provided at a lower side of the seating plate 140, the garment may be loaded onto the first conveyor 211 while being pulled by the clip assembly 130 and vertically folded primarily and manually.

As described above, the loading by the loading unit 100 and the vertical folding are performed at the same time in the first folding layer 210, such that the folding process may be simplified and the size of the machine may be reduced.

Meanwhile, the second folding layer 220 may be provided with a vertical folding assembly 222 in order to vertically fold the garment C conveyed from the first folding layer 210.

The vertical folding assembly 222 may be configured as an active assembly having a mechanism that actively and vertically folds the garment C by receiving a force from a vertical folding motor M22 (see FIG. 8) which is a driving source.

As an example, the vertical folding assembly 222 may include vertical folding plates 2221 (see FIG. 7) configured such that a position thereof is changed by the force from the vertical folding motor M22.

The pair of vertical folding plates 2221 having approximately the same shape may be provided, and the second conveyor 221 is disposed between the pair of vertical folding plates 2221.

The vertical folding plates 2221 are on standby on the same plane as an upper surface of the second conveyor at the initial position. In order to vertically fold the garment delivered from the first conveyor 211 and deployed on the second conveyor 221 and the vertical folding plates 2221, the pair of vertical folding plates 2221 lifts up two opposite portions of the garment and moving the two opposite portions of the garment toward the inside of the garment, thereby vertically folding the garment.

The vertical folding assembly 222 may further include plate position sensors (not illustrated) capable of detecting an initial position and a vertical folding completion position of the vertical folding plates 2221.

As an example, the vertical folding assembly 222 including the pair of vertical folding plates 2221 to perform the active vertical folding will be described below, but the present disclosure is not limited thereto. A specific shape and a specific structure of the vertical folding assembly 222 will be described below in detail with reference to FIG. 7.

The unloading unit 300 is provided to collect and discharge the folded garment.

The unloading unit 300 is configured such that the completely folded garment is conveyed from the unloading layer 310 (see FIG. 3) by the unloading conveyor 311 and collected in the discharge unit 301. Specifically, the unloading unit 300 may be configured such that the completely folded garment is conveyed by the unloading conveyor 311 and collected in the discharge unit 301 between the horizontal frame 116 and the lower frame 112.

As an embodiment, the garment dropped by the folding assembly is disposed on the unloading conveyor 311. Thereafter, the unloading conveyor 311 moves in the forward/rearward direction, and at the same time, an unloading plate (not illustrated) moves in the upward/downward direction, such that the completely folded garments are uniformly collected in an internal space of the discharge unit 301.

Figure 4:
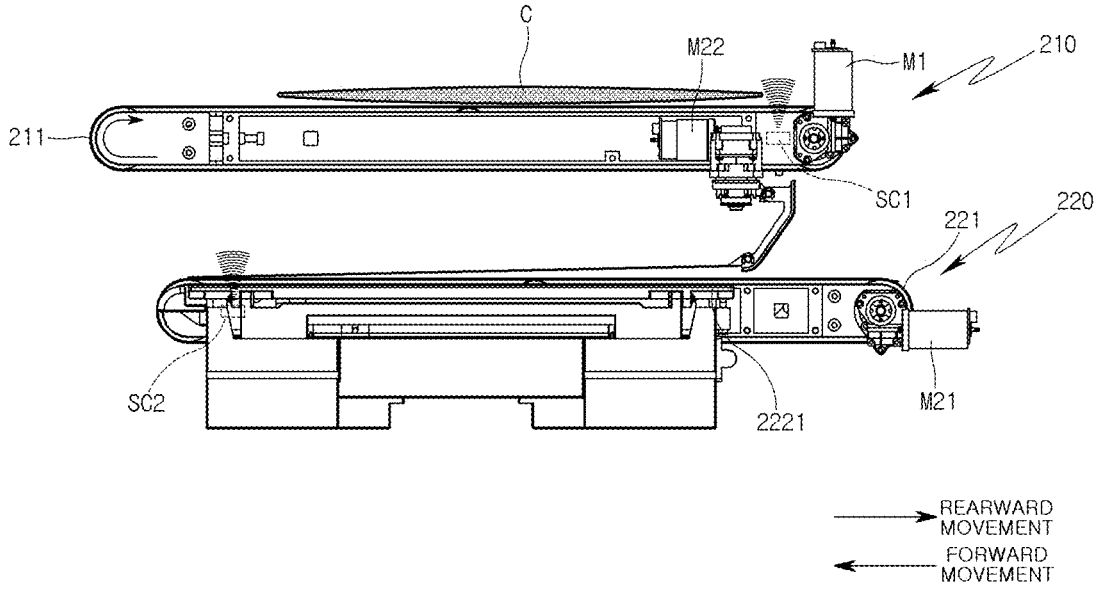
FIGS. 4 and 5 are schematic views for explaining a process of conveying a garment from a first folding layer to a second folding layer after the garment is completely loaded by a loading unit.

FIG. 4 illustrates a state in which the first conveyor motor M1 operates rearward and the first conveyor 211 conveys the garment C.

As illustrated in FIG. 4, when the garment C is conveyed by the movement of the first conveyor 211, a first-conveyor-rear-end garment detection sensor SC1 detects whether a tip of the garment C reaches a rear end of the first conveyor 211.

When the first-conveyor-rear-end garment detection sensor SC1 detects that the tip of the garment C reaches the rear end of the first conveyor 211, the second conveyor motor M21 operates forward at the same time to deliver the garment C to the second folding layer 220.

In this case, in order to prevent the garment C being delivered from being wrinkled due to a difference in linear velocity between the second conveyor 221 and the first conveyor 211, the linear velocity of the second conveyor 221 and the linear velocity of the first conveyor 211 may be maintained to be almost equal.

The first-conveyor-rear-end garment detection sensor SC1 may be an IR sensor. In addition, the first-conveyor-rear-end garment detection sensor SC1 may be a freely selected sensor such as a distance sensor, an optical sensor, and a switch sensor that may detect the position of the garment.

Figure 5:
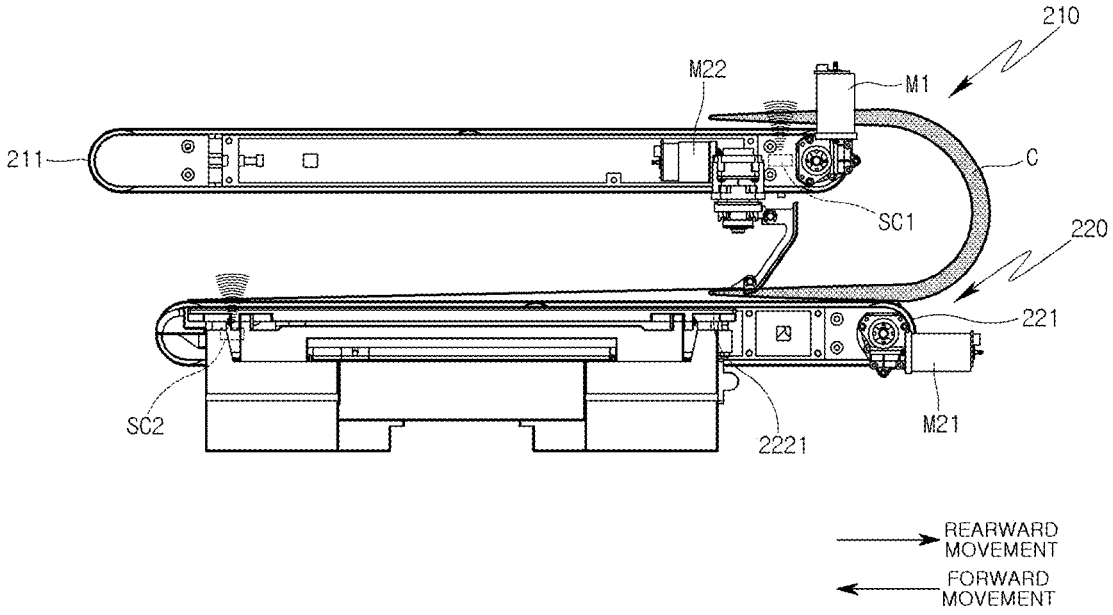
Figure 6A:
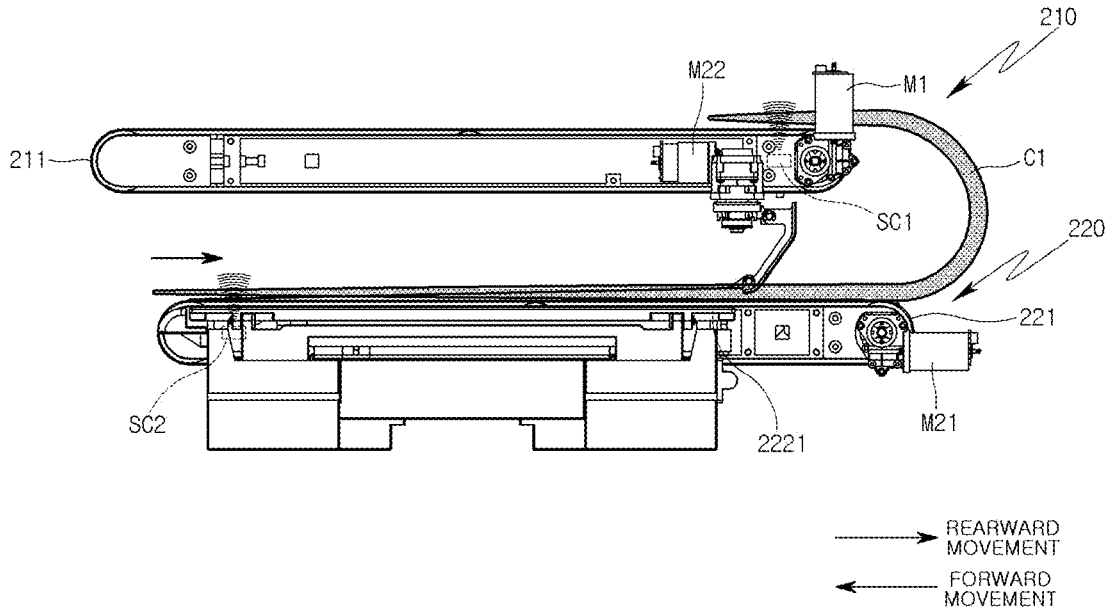
FIGS. 6A and 6B are schematic views for explaining a process of conveying a garment, which has a longer length than a typical garment, from the first folding layer to the second folding layer after the garment is completely loaded by the loading unit, and for explaining a process in which a motor operates rearward to reduce tension.
Figure 6B:
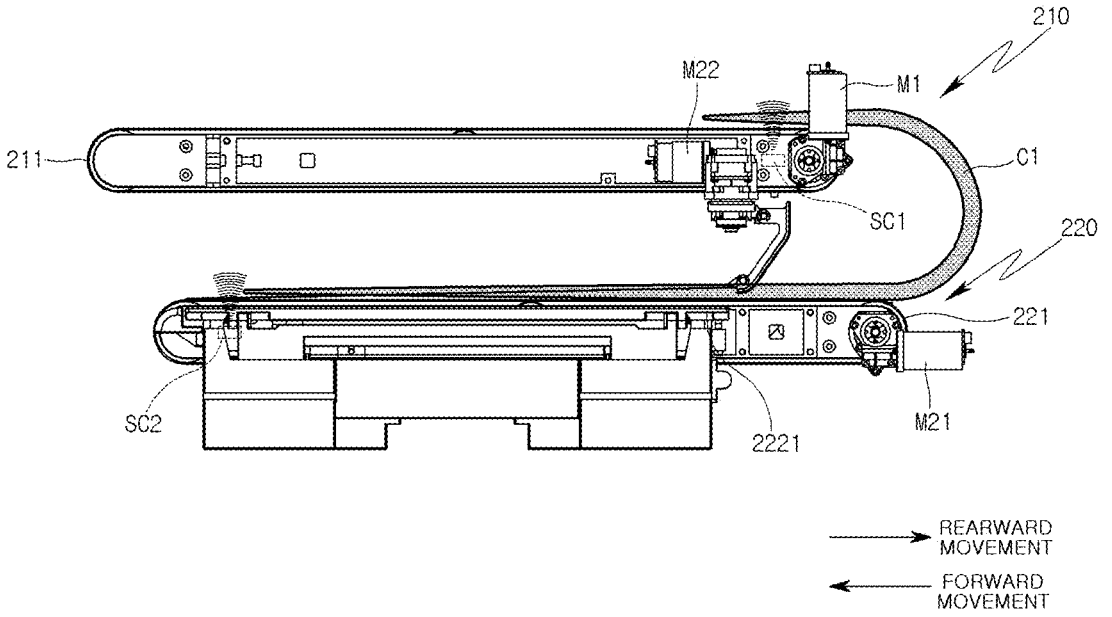

FIGS. 5, 6A, and 6B illustrate a process of delivering the garment C from the rear end of the first conveyor 211 to a rear end of the second conveyor 221 as the first-conveyor-rear-end garment detection sensor SC1 detects that the tip of the garment C reaches the rear end of the first conveyor 211.

As described above, when the first-conveyor-rear-end garment detection sensor SC1 detects that the garment C successfully reaches the rear end of the first conveyor 211, the second conveyor motor M21 operates forward at the same time, and the second conveyor 221 operates forward to convey the garment C forward.

In this case, a front end of the second conveyor 221 is a target position at which whether the garment C is successfully conveyed from the first conveyor 211 to the second conveyor 221 is determined. To this end, the second conveyor 221 is provided with a second-conveyor-front-end garment detection sensor SC2 that detects whether the tip of the garment C reaches the corresponding target position. Like the first-conveyor-rear-end garment detection sensor SC1, an IR sensor may be selected as the second-conveyor-front-end garment detection sensor SC2.

Meanwhile, when the second-conveyor-front-end garment detection sensor SC2 detects that the garment C successfully reaches the front end of the second conveyor 221, the next process is determined depending on whether the garment C needs to be subjected to the vertical folding.

If the garment C is set in advance as an object such as an upper garment to be subjected to the vertical folding, the second conveyor motor M21 is stopped when the tip of the garment C reaches the front end of the second conveyor 221, and the vertical folding assembly 222 operates to perform the vertical folding on the garment C.

In more detail, first, electric current is supplied to the vertical folding motor M22, and the vertical folding motor M22 operates.

The pair of vertical folding plates 2221 is moved, by the operation of the vertical folding motor M22, from the standby position toward a center of the garment C by a movement amount corresponding to a vertical folding width set in advance to the garment C to be vertically folded.

When the vertical folding is completely performed on the garment C by the movement of the vertical folding plate 2221, the vertical folding motor M22 operates in a reverse direction to return the vertical folding plates 2221 to the standby position.

Next, when it is determined that the vertical folding plates 2221 has been returned to the standby position, the second conveyor motor M21 operates forward to convey the garment C to the third folding layer 230, and at the same time, the third conveyor motor M31 of the third folding layer 230 for receiving the garment C operates rearward.

A specific configuration of the vertical folding assembly 222 will be described below in detail with reference to FIG. 7.

Meanwhile, if the garment C is not set in advance as an object such as an upper garment to be subjected to the vertical folding, the process of vertically folding the garment C is omitted, the second conveyor motor M21 continuously operates forward without being stopped, and the third conveyor motor M31 of the third folding layer 230 for receiving the garment C operates rearward.

Meanwhile, FIGS. 6A and 6B illustrate a process of delivering a garment C1, which is longer than a typical garment C, from the rear end of the first conveyor 211 to the rear end of the second conveyor 221.

During the process of delivering the typical garment C from the rear end of the first conveyor 211 to the rear end of the second conveyor 221, the garment C is not detected by the first-conveyor-rear-end garment detection sensor SC1 before the entry of the garment C is detected by the second-conveyor-front-end garment detection sensor SC2.

However, the garment C1 longer than the typical garment C may be delivered to the second conveyor 221. In this case, as illustrated in FIG. 6A, the second-conveyor-front-end garment detection sensor SC2 may detect the entry of the garment C1 before the garment C1 is not detected by the first-conveyor-rear-end garment detection sensor SC1.

The first conveyor 211 and the second conveyor 221 are typically designed to operate in the opposite directions, and as a result, tension T may be applied to the garment C1 by forces that operates the first conveyor 211 and the second conveyor 221 in the opposite directions. When the tension T is applied to the garment C1, there may occur problems in that the garment C1 may be damaged, and the vertical folding cannot be performed even though the vertical folding plates 2221 are moved upward in a vertical folding process to be described below.

In order to solve the above-mentioned problems, the control unit 400 may operate the second conveyor 221 rearward when the second-conveyor-front-end garment detection sensor SC2 detects the entry of the garment C1, thereby reducing the tension applied to the garment C1.

More specifically, when the second-conveyor-front-end garment detection sensor SC2 detects the entry of the garment C1 before the garment C1 is not detected by the first conveyor-rear-end garment detection sensor SC1, the control unit 400 may determine that the entering garment C1 has a length longer than a standard length, recognize that a part of the entering garment C1 is still disposed on the first conveyor, and then operate the second conveyor 221 rearward to eliminate the tension applied to the garment C1.

In addition, the control unit 400 may temporarily stop the second conveyor 221 before operating the second conveyor 221 rearward. This method prevents a breakdown that may occur when the second conveyor motor M21 immediately operates rearward to immediately operate rearward the second conveyor 221 which is moving forward. Further, the above-mentioned method may prevent a situation in which a portion of the garment C1, which is disposed on the second conveyor 221 without being disposed in a space between the first conveyor 211 and the second conveyor 221, may be wrinkled or folded when the garment C1, which is being moved forward, is immediately moved rearward.

Referring to FIG. 6B, when the second conveyor motor M21 operates rearward and the garment C1 is moved rearward together with the second conveyor 221 and thus departs from the upper side of the second-conveyor-front-end garment detection sensor SC2, the second-conveyor-front-end garment detection sensor SC2 stops transmitting a garment detection signal.

When the control unit 400 does not receive the garment detection signal transmitted from the second-conveyor-front-end garment detection sensor SC2, the control unit 400 may control and temporarily stop the second conveyor motor M21. In order to dispose the garment C1 at an optimal position for the vertical folding process to be performed subsequently, the control unit 400 may temporarily stop the second conveyor motor M21 when a predetermined time T elapses after the control unit 400 does not receive the garment detection signal transmitted from the second-conveyor-front-end garment detection sensor SC2.

The predetermined time T may be calculated by dividing a distance d by which the garment moves from the second-conveyor-front-end garment detection sensor SC2 by a rotational speed v of the second conveyor motor M21. A motor selected from the motors existing in the related art may be adopted as the second conveyor motor M21. Because the rotational speeds v may vary depending on the types of motors, the control unit 400 may optionally set the predetermined time T in consideration of the rotational speeds v.

Figure 7:
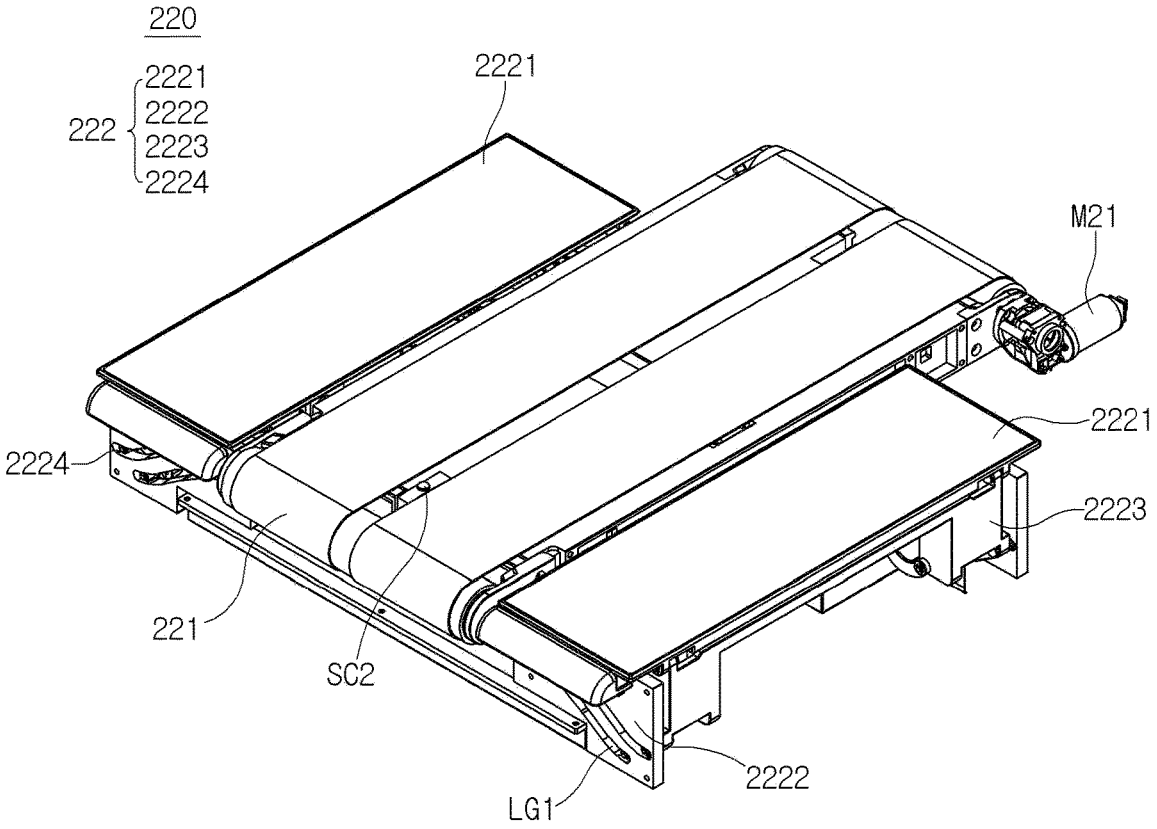
FIG. 7 is a schematic view for explaining a configuration of the second folding layer of the garment folding machine according to the present disclosure.
Figure 8:
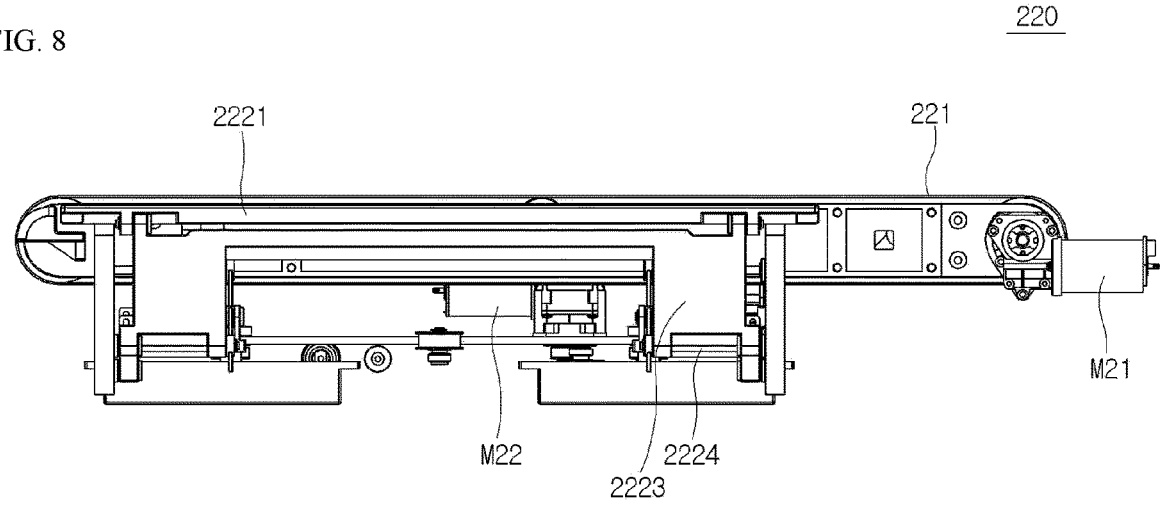
FIG. 8 is a side view for explaining a configuration of the second folding layer of the garment folding machine according to the present disclosure.

FIG. 7 is a schematic view of the second folding layer including the vertical folding assembly, and FIG. 8 is a side view of the second folding layer including the vertical folding assembly.

Referring to FIGS. 7 and 8, the vertical folding assembly 222 may include the vertical folding plates 2221 and the vertical folding motor M22.

Specifically, the vertical folding motor M22 provides driving power for the vertical folding and may be disposed in an internal space defined below the second conveyor. A motor selected from the motors well known in the art, which may provide driving power required to perform the vertical folding process using the vertical folding plates 2221, may be adopted as the vertical folding motor M22.

In the embodiment illustrated in FIG. 7, the vertical folding plates 2221 may be provided in the form of a pair of boards with the second conveyor 221 interposed therebetween. The garment C may have a width such that two opposite ends of the garment C loaded onto the second conveyor 221 may be disposed on the vertical folding plates 2221 while passing the second conveyor 221. In this case, the control unit 400 may operate the vertical folding motor M22 to lift up the vertical folding plates 2221, thereby vertically folding the two opposite ends of the garment C toward a body part of the garment C. In order to prevent the two opposite ends of the garment C from being folded and colliding with both sides of the garment and thus prevent a situation in which the vertical folding is not performed, the vertical folding plates 2221 may sequentially perform the vertical folding twice.

Referring to FIGS. 7 and 8, the vertical folding assembly 222 may further include vertical folding frames 2222, plate support parts 2223, and vertical folding link pins 2224.

Specifically, the vertical folding frames 2222 may be provided to define the internal space below the second conveyor 221. The vertical folding motor M22 may be disposed in the internal space defined by the vertical folding frames 2222. In addition, a connection device (not illustrated) may be provided to connect the vertical folding motor M22 and the vertical folding plates 2221 and transmit power.

The plate support parts 2223 may be provided below the flat-plate-shaped vertical folding plates 2221 to support the flat-plate-shaped vertical folding plates 2221. According to the present embodiment, when the plate support parts 2223 move upward, the vertical folding plates 2221 may be operated and moved upward together with the plate support parts 2223.

The plate support part 2223 may be coupled to the vertical folding frame 2222. Referring to the embodiment illustrated in FIG. 8, the plate support part 2223 and the vertical folding frame 2222 may be connected with the vertical folding link pin 2224 provided in the vertical folding assembly 222. The vertical folding link pin 2224 is penetratively coupled to the plate support part 2223 and connected to a sidewall of the vertical folding frame 2222, such that the vertical folding link pin 2224 may serve as a fastening part for fastening the plate support part 2223 and the vertical folding frame 2222.

The movement of the plate support part 2223 may be guided by a vertical folding link guide hole LG1 provided in the vertical folding frame 2222. According to the present embodiment, the vertical folding link pin 2224 may be coupled to and fitted into the vertical folding link guide hole LG1. The vertical folding link guide hole LG1 may be formed in the sidewall of the vertical folding frame 2222. In order to guide the movement of the vertical folding link pin 2224, the vertical folding link guide hole LG1 may extend in a streamlined shape so that a portion of the vertical folding link guide hole LG1, which is adjacent to the second conveyor 221, is positioned at a higher position. The plate support parts 2223 are moved upward by the movements of the vertical folding link pins 2224, and the vertical folding plates 2221 may be operated and moved upward together with the plate support parts 2223. In addition, it is possible to prevent the plate support parts 2223 from passing the vertical folding frames 2222 and deviating from the normal positions thereof.

The control unit 400 may control the vertical folding motor M22 to return the position of the vertical folding plates 2221 to the standby position while controlling and operating the second conveyor motor M21 rearward. According to the embodiment of the present disclosure, in order to normally performing the vertical folding, the second conveyor motor M21 may be stopped first after the garment C is disposed on the second conveyor 221. However, the vertical folding motor M22 may operate first to move the position of the vertical folding plates 2221. There is a risk of malfunction during the process of continuously folding the plurality of garments C.

If the second conveyor motor is controlled and operated rearward in a state in which the position of the vertical folding plates 2221 is changed, there may occur a problem in that the garment C is unintentionally lumped or tangled. In order to avoid the malfunction, the control unit 400 detects the position of the vertical folding plates 2221 before controlling and operating the second conveyor motor M21 rearward, and when the detection result indicates that the position has been changed, the control unit 400 may return the position of the vertical folding plates 2221 to the standby position.

Figure 9:
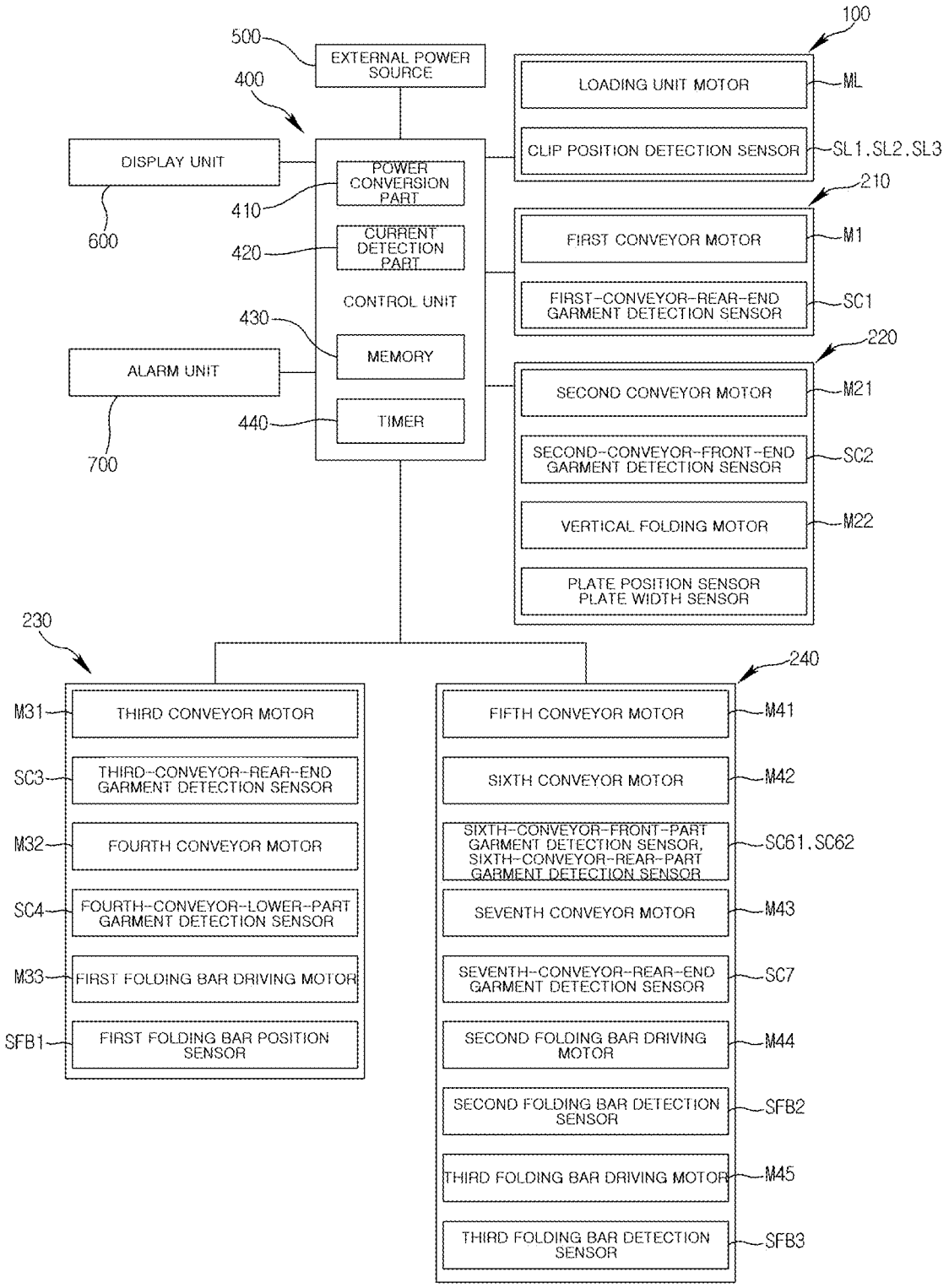
FIG. 9 is a functional block diagram for explaining a configuration of a control unit of the garment folding machine according to the present disclosure.
Figure 10:
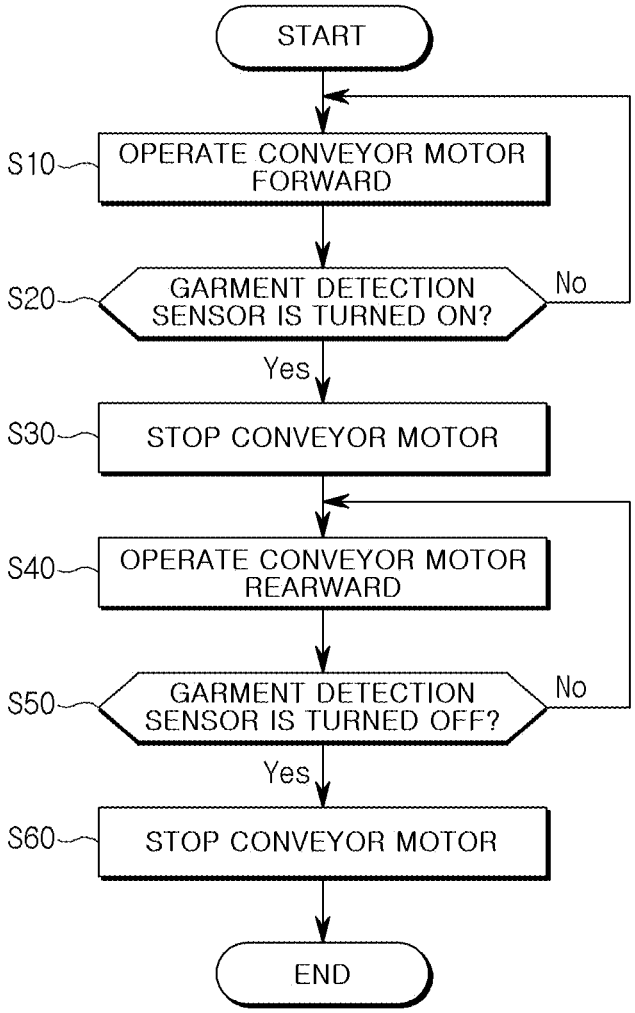
FIG. 10 is a flowchart for explaining a step of controlling a disposition of a garment during a process of conveying and folding the garment according to the present disclosure.
Figure 11:
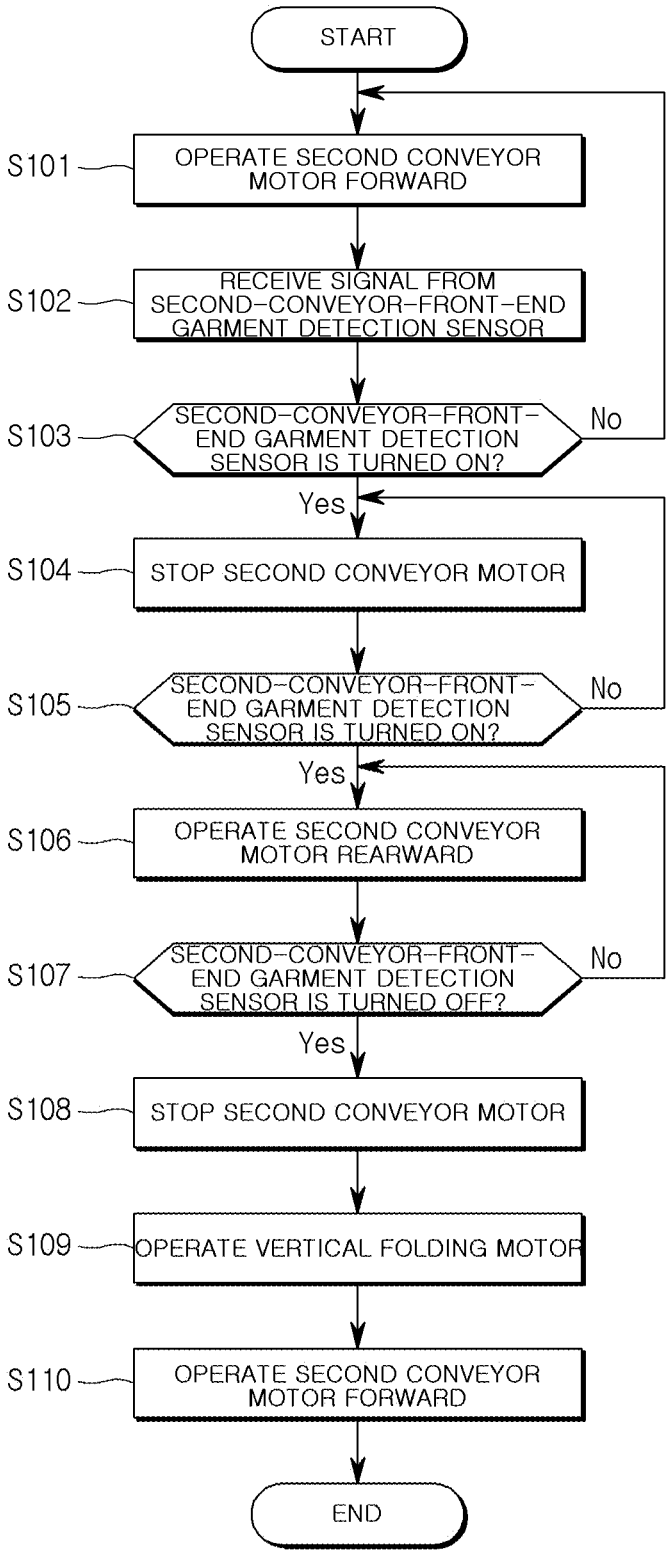
FIG. 11 is a flowchart for explaining a step of controlling a disposition of a garment and a vertical folding step during a process of conveying and folding the garment in the second folding layer according to the present disclosure.

FIG. 9 is a functional block diagram illustrating a configuration of the control unit 400 of the garment folding machine 1 according to the present disclosure, FIG. 10 is a flowchart for explaining a step of controlling a disposition of the garment C during a process of conveying and folding the garment C according to the present disclosure, and FIG. 11 is a flowchart for explaining a step of controlling a disposition of the garment C and the vertical folding step during a process of conveying and folding the garment C in the second folding layer in the embodiment according to the present disclosure.

Hereinafter, a method of controlling the garment folding machine 1 according to the present disclosure will be described with reference to FIG. 9 and following drawings, focusing on the control unit 400.

As illustrated, the control unit 400 is electrically connected to the loading unit 100, the first folding layer 210, the second folding layer 220, the third folding layer 230, and the fourth folding layer 240 and generates a control signal for controlling the loading unit 100, the first folding layer 210, the second folding layer 220, the third folding layer 230, and the fourth folding layer 240. Although not illustrated, the control unit 400 may also be electrically connected to the unloading layer 310 and may control the unloading layer 310 so that the garment C, which is completely folded vertically or horizontally, is automatically accommodated in the discharge unit.

Meanwhile, the control unit 400 may be electrically connected to the input unit (not illustrated) to receive the user's control instruction, and electrically connected to the display unit 600 and the alarm unit 700 to provide the display unit 600 and the alarm unit 700 with the information on the operating state of the garment folding machine 1, thereby transmitting the corresponding information to the user.

In addition, the control unit 400 controls a power conversion part 410 and a current detection part 420, the power conversion part 410 converts power inputted from the external power source 500 and supplies the power to the loading unit 200, first to fourth folding layers 210, 220, 230, and 240, and the unloading layer 310, and the current detection part 420 detects the electric current supplied from the power conversion part 410 to the loading unit 200, the first to fourth folding layers 210, 220, 230, and 240, and the unloading layer 310.

FIG. 9 illustrates the configuration in which the control unit 400 includes the power conversion part 410 and the current detection part 420, but the present disclosure is not limited thereto. It can be seen that a configuration in which the power conversion part 410 and the current detection part 420 are provided independently of the control unit 400 also falls into the scope of the present disclosure. For convenience, the embodiment in which the control unit 400 includes the power conversion part 410 and the current detection part 420 will be described below.

Referring to the embodiment illustrated in FIG. 10, the control unit 400 operates the conveyor motor forward by supplying the electric current, through the power conversion part 410, to the conveyor motor provided in at least any one of the first to fourth folding layers 210, 220, 230, and 240 in order to convey or fold the garment C (S10).

According to the embodiment of the present disclosure, the first, third, and fourth conveyor motors may operate rearward to move the garment in the proceeding direction, and the second, fifth, sixth, and seventh conveyor motors may operate forward to move the garment in the proceeding direction. However, for convenience, in this step, an operation of moving the garment C in the proceeding direction, that is, forward direction is referred to as the forward operation.

When the garment C is conveyed by the conveyor motor forward operation step S10, the control unit 400 determines the position of the garment C based on whether an output signal is received from the garment detection sensor that detects whether the garment C reaches the upper side (S20).

According to the embodiment of the present disclosure, in the first folding layer 210 during the process of moving the garment C, the first-conveyor-rear-end garment detection sensor SC1 provided in the first folding layer 210 may determine the position of the garment. In addition, in the second folding layer 220, the second-conveyor-front-end garment detection sensor SC2 included in the second folding layer 220 may determine the position of the garment. In the third folding layer 230, a third-conveyor-rear-end garment detection sensor SC3 included in the third folding layer 230 may determine the position of the garment.

In the step S20 of determining the position of the garment C, when the control unit 400 determines that the position of the garment C departs from the garment detection sensor, the control unit 400 stops the conveyor motor that is operating to convey the garment (S30).

In contrast, in the step S20 of determining the position of the garment C, when the control unit 400 determines that the position of the garment C does not depart from the garment detection sensor, the control unit 400 maintains the operation of the conveyor motor.

Next, the control unit 400 operates the stopped conveyor motor rearward (S40).

According to the embodiment of the present disclosure, the first, third, and fourth conveyor motors may operate forward to move the garment in the reverse direction to the proceeding direction, and the second, fifth, sixth, and seventh conveyor motors operate rearward to move the garment in the reverse direction to the proceeding direction. However, for convenience, in this step, an operation of the motor for moving the garment C in the reverse direction is referred to as the rearward operation.

In the conveyor motor rearward operation step S40, when the conveyor motor operates rearward and the garment C is disposed on the conveyor so that the position of the garment C does not depart from the garment detection sensor, the operation of the garment detection sensor is stopped (S50).

When the operation of the garment detection sensor is stopped, the garment detection sensor stops transmitting the detection signal to the control unit 400.

When the operation of the garment detection sensor is stopped in a step S50 of stopping the operation of the garment detection sensor, the control unit 400 stops the conveyor motor S60.

In a conveyor motor stopping step S60, the control unit 400 may stop the conveyor motor after a predetermined time t0 elapses, and the predetermined time t0 is calculated in consideration of a rotational speed v0 of the conveyor motor and a rearward movement distance d0 stored in a memory 430 after the operation of the garment detection sensor is stopped (not illustrated).

Therefore, the present disclosure may effectively prevent damage to the garment C caused by tension by determining the disposition position of the garment C on the basis of the above-mentioned clear and simplified determination criterion and improve efficiency of the folding process of the garment folding machine 1 by appropriately disposing the position of the garment C by controlling the conveyor motor.

In particular, a rearward operation process and a process of determining a disposition of the garment in the second folding layer will be specifically described below.

Referring to FIG. 11, the start step refers to a step in which the garment is conveyed from the first folding layer 210 and loaded into the second folding layer 220.

Second-folding-layer-garment-position detection steps S101 to S103 in which the control unit 400 operates the second folding layer 220, recognizes a disposed state of the garment C in the second folding layer 210, and determines whether tension is applied to the garment C will be described with reference to FIG. 11.

As illustrated, the second-folding-layer-garment-position detection steps S101 to S103 include the following sub-steps.

When the garment C passes through the upper side of the first-conveyor-rear-end garment detection sensor SC1, the control unit 400 receives the garment detection signal from the first-conveyor-rear-end garment detection sensor SC1 and operates the second conveyor motor M21 forward (S101).

The garment C passes the rear end of the first conveyor 211, falls by its weight, and is disposed at the rear end of the second conveyor 221. The garment C is conveyed to the front end of the second conveyor 221 by the circulation movement of the second conveyor 221.

When the garment C being guided to the lower end of the second conveyor 221 passes through the upper side of the second-conveyor-front-end garment detection sensor SC2 as the step S101 of operating the second conveyor motor forward is performed, the second-conveyor-front-end garment detection sensor SC2 detects the entry of the garment and transmits a signal.

The control unit 400 receives the garment entry detection signal transmitted from the second-conveyor-front-end garment detection sensor SC2 (S102).

After the step S102 of receiving the signal from the second-conveyor-front-end garment detection sensor, the control unit 400 determines that the garment C is disposed at the upper side of the second-conveyor-front-end garment detection sensor SC2 when the control unit 400 receives the garment entry detection signal (S103).

As illustrated, second-conveyor-motor-rearward-operation control steps S104 to S108 include the following sub-steps.

When the control unit 400 receives the garment detection signal transmitted from the second-conveyor-front-end garment detection sensor SC2, the control unit 400 stops the second conveyor motor M21 (S104).

After the second conveyor motor M21 is stopped by the second conveyor motor stopping step S104, the control unit 400 determines whether the second-conveyor-front-end garment detection sensor transmits the signal (S105).

In this case, in a case in which the reception of the garment detection signal from the first-conveyor-rear-end garment detection sensor SC1 is not stopped, that is, the garment detection signal from the first-conveyor-rear-end garment detection sensor SC1 and the garment detection signal from the second-conveyor-front-end garment detection sensor SC2 are received at the same time, the control unit 400 determines that tension is applied to the garment C.

In contrast, in the case in which the reception of the garment detection signal from the first-conveyor-rear-end garment detection sensor SC1 is stopped, a vertical folding step S109 to be described below may be immediately performed (not illustrated).

The control unit 400 operates the second conveyor motor M21 rearward in order to reduce the tension applied when the garment C is disposed on the first conveyor 211 and the second conveyor 221 (S106).

When the second conveyor conveys the garment C rearward by the rearward operation of the second conveyor motor M21, the garment detection by the second-conveyor-front-end garment detection sensor SC2 is stopped (S107).

When the garment detection is stopped, the second-conveyor-front-end garment detection sensor SC2 stops transmitting the garment detection signal.

After the step S107 of stopping the garment detection by the second-conveyor-front-end garment detection sensor SC2, the control unit 400 stops the second conveyor motor M21 when the reception of the garment detection signal is stopped (S108).

In the step S108, the control unit 400 may immediately stop the second conveyor motor M21 by cutting off the supply of electric current to the second conveyor motor M21 through the power conversion part 410. The control unit 400 may stop the second conveyor motor M21 after a predetermined time T elapses, and the predetermined time T is calculated in consideration of the rotational speed v of the conveyor motor and the rearward movement distance d stored in the memory 430.

Meanwhile, the method may further include the vertical folding step S109 to be performed after the end of the second-conveyor-motor-rearward-operation control steps S104 to S108.

Specifically, when the second conveyor motor M21 is stopped, the control unit 400 operates the vertical folding motor M22 by supplying the electric current to the vertical folding motor M22 through the power conversion part 410 in order to operate the vertical folding plates 2221.

When the vertical folding motor M22 operates, the plate support parts 2223 are moved by means of the connection device, such that the vertical folding plates 2221 may be moved upward together with the plate support parts 2223.

After the vertical folding plates 2221 operate, the control unit 400 receives the output signal from the plate position sensor in order to check whether the vertical folding plates 2221 completely fold the garment C vertically to a preset vertical folding width. Based on the output signal, the control unit 400 checks whether the vertical folding plates 2221 have returned to the standby position.

When it is determined that the vertical folding plates 2221 have returned to the standby position, the control unit 400 operates the second conveyor motor M21 forward by supplying the electric current to the second conveyor motor M21 through the power conversion part 410 in order to move the vertically folded garment C to the third folding layer 230 (S110).

Referring to FIG. 11, the end step means a step in which the garment C passes through the front end of the second conveyor 221. Thereafter, the third folding layer 230 begins to operate. The above-mentioned contents may be used to describe the series of processes of folding and discharging the garment through the third folding layer 230, the folding unit 200, and the unloading unit 300.

It can be understood that the above-mentioned technical features of the present disclosure may be carried out in any other specific form by those skilled in the art without changing the technical spirit or the essential features of the present disclosure.

Accordingly, it should be understood that the aforementioned embodiments are described for illustration in all aspects and are not limited, and the scope of the present disclosure shall be represented by the claims to be described below, and it should be construed that all of the changes or modified forms derived from the meaning and the scope of the claims, and an equivalent concept thereto are included in the scope of the present disclosure.

DESCRIPTION OF REFERENCE NUMERALS

1: Garment folding machine
100: Loading unit
200: Folding unit
210: First folding layer
211: First conveyor
M1: First conveyor motor
SC1: First-conveyor-rear-end garment detection sensor
220: Second folding layer
221: Second conveyor
M21: Second conveyor motor
SC2: Second-conveyor-front-end garment detection sensor
222: Vertical folding assembly
2221: Vertical folding plate
2222: Vertical folding frame
2223: Plate support part
2224: Vertical folding link pin
M22: Vertical folding motor
LG1: Vertical folding link guide hole
230: Third folding layer
M31: Third conveyor motor
232: Fourth conveyor
M32: Fourth conveyor motor
240: Fourth folding layer
241: Fifth conveyor
242: Sixth conveyor
243: Seventh conveyor
400: Control unit

What is claimed is:

1. A garment folding machine comprising:
a frame unit configured to define an external shape;
a loading unit supported on the frame unit and configured to load a garment;
a folding unit including two or more folding layers configured to convey the garment loaded by the loading unit and to fold the garment;
an unloading unit configured to discharge the garment folded by the folding unit; and
a control unit configured to generate a control signal for controlling the loading unit and the folding unit,
wherein the folding unit comprises:
a first folding layer; and
a second folding layer disposed below the first folding layer and configured to vertically fold the garment conveyed from the first folding layer,
wherein the second folding layer comprises:
a second conveyor configured to circulate to allow the garment to slide;
a second conveyor motor configured to operate forward or rearward to provide power for operating the second conveyor; and
a second-conveyor-front-end garment detection sensor disposed at a front end of the second conveyor and configured to detect an entry of the garment and transmit a signal to the control unit, and
wherein the control unit controls and operates the second conveyor motor rearward when the control unit receives the signal transmitted from the second-conveyor-front-end garment detection sensor.

2. The garment folding machine of claim 1, wherein the control unit controls and temporarily stops the second conveyor motor when reception of the signal transmitted from the second-conveyor-front-end garment detection sensor is stopped.

3. The garment folding machine of claim 1, wherein the control unit controls and operates the second conveyor motor rearward at a speed lower than a forward operation speed.

4. The garment folding machine of claim 1, wherein the first folding layer comprises:
a first conveyor configured to circulate to allow the garment to slide;
a first conveyor motor configured to operate forward or rearward to provide power for operating the first conveyor; and
a first-conveyor-rear-end garment detection sensor disposed at a rear end of the first conveyor and configured to detect an entry of the garment and transmit a signal to the control unit, and
wherein the control unit controls and operates the second conveyor motor rearward when the control unit receives the signal transmitted from the second-conveyor-front-end garment detection sensor before the reception of the signal transmitted from the first-conveyor-rear-end garment detection sensor is stopped.

5. The garment folding machine of claim 2, wherein the second folding layer further comprises:
a vertical folding assembly configured to implement vertical folding on the garment conveyed from the first folding layer,
wherein the vertical folding assembly further comprises:
a vertical folding motor configured to provide driving power for the vertical folding; and
vertical folding plates provided in the form of a pair of boards with the second conveyor interposed therebetween and configured to perform the vertical folding on the garment loaded to the second conveyor, and
wherein the control unit performs control such that when the second conveyor motor is temporarily stopped after the garment is loaded to the second conveyor, the vertical folding motor operates to move the vertical folding plates upward to vertically fold the garment.

6. The garment folding machine of claim 5, wherein the vertical folding assembly further comprises:
plate support parts disposed below the vertical folding plates, connected to the vertical folding motor, and configured to move the vertical folding plates upward by being supplied with driving power;
vertical folding frames configured to define an internal space in which the plate support parts are disposed; and
vertical folding link pins connected to the vertical folding frames while penetrating the plate support parts, and
wherein vertical folding link guide holes for guiding movements of the vertical folding link pins are formed in sidewalls of the vertical folding frames.

7. A method of controlling a garment folding machine having a plurality of folding layers each configured to perform a function of folding a garment or a function of conveying the garment using one or more conveyors, the method comprising:

a folding layer operating step of controlling an operation of a conveyor motor that operates the one or more conveyors to fold or convey the garment;

a garment position detection step of detecting a position of the garment using a garment detection sensor provided in the folding layer after the conveyor motor operates; and a rearward operation control step of controlling and operating the conveyor motor rearward when receiving a signal transmitted from the garment position detection step.

8. The method of claim 7, wherein the garment position detection step comprises a signal transmission stopping step of determining that the garment departs from an upper side of the garment detection sensor when the detection of the entry of the garment is stopped as the conveyor motor operates rearward in the rearward operation control step, and stopping the reception of the rearward operation signal from the garment detection sensor, and wherein the rearward operation control step is ended when the reception of the rearward operation signal is stopped.

9. The method of claim 7, wherein the folding layer operating step comprises:

a first folding layer operating step of operating a first folding layer which is an uppermost layer among the plurality of folding layers; and a second folding layer operating step of operating a second folding layer disposed below the first folding layer, wherein the garment position detection step comprises a second-folding-layer-garment-position detection step of detecting the entry of the garment using a second-conveyor-front-end garment detection sensor disposed at one side of the second folding layer, and wherein the rearward operation control step comprises a second-conveyor-motor-rearward-operation control step of controlling and operating a second conveyor motor rearward.

10. The method of claim 9, wherein the second-folding-layer-garment-position detection step comprises a second signal transmission stopping step of stopping transmitting a rearward operation signal from the second-conveyor-front-end garment detection sensor to a control unit when the detection of the entry of the garment by the second-conveyor-front-end garment detection sensor is stopped as the second conveyor motor operates rearward, and wherein the second-conveyor-motor-rearward-operation control step is controlled and immediately ended when the reception of the rearward operation signal is stopped.

11. The method of claim 7, further comprising:

a vertical folding step of performing vertical folding on the garment loaded into the folding layer using a vertical folding assembly provided in the one or more folding layers.

12. The method of claim 11, wherein the vertical folding step comprises:

a vertical folding motor control step of controlling and operating a vertical folding motor provided in the vertical folding assembly when it is determined that the garment loaded into the folding layer reaches a vertical folding position; and a vertical folding performing step of vertically folding the garment by vertical folding plates moved upward by power of the operating vertical folding motor.

13. The method of claim 12, wherein the vertical folding step comprises:

a vertical folding motor returning control step of returning the vertical folding plates while controlling the rearward operation of the conveyor motor when it is determined that the garment moves and departs from the vertical folding position; and a vertical folding returning control stopping step of stopping the returning control for the vertical folding plates when reception of a garment entry detection signal from the garment detection sensor is stopped as the conveyor motor operates rearward, and wherein the vertical folding motor control step is performed again when the vertical folding returning control stopping step is ended.

14. The method of claim 11, wherein the folding layer operating step comprises:

a first folding layer operating step of operating a first folding layer which is an uppermost layer among the plurality of folding layers; and a second folding layer operating step of operating a second folding layer disposed below the first folding layer, wherein the garment position detection step comprises a second-folding-layer-garment-position detection step of determining that the garment departs from a target position, by receiving, by a control unit, a signal transmitted when a second-conveyor-front-end garment detection sensor disposed at one side of the second folding layer detects the loaded garment, and wherein the vertical folding step comprises a second-folding-layer vertical folding step of performing vertical folding on the garment loaded into the second folding layer using a vertical folding assembly disposed at one side of the second folding layer.

* * * * *